US005366798A

United States Patent [19]

Ostermayer

[11] Patent Number: 5,366,798

[45] Date of Patent: Nov. 22, 1994

[54] MULTI-LAYERED PAPERMAKING FABRIC HAVING STABILIZED STACKED WEFT YARN

[75] Inventor: Volker Ostermayer, Greenville, S.C.

[73] Assignee: Wangner Systems Corporation, Greenville, S.C.

[21] Appl. No.: 159,839

[22] Filed: Nov. 30, 1993

[51] Int. Cl.[5] ..... D03D 3/00

[52] U.S. Cl. ..... 428/229; 139/383 A; 162/348; 428/225; 428/257; 428/258

[58] Field of Search ..... 428/225, 257, 258, 229; 162/348, DIG. 1; 139/411, 412, 383 A

[56] References Cited

U.S. PATENT DOCUMENTS

| | | | |
|---|---|---|---|
| 2,288,512 | 6/1942 | Buchanan | 139/425 |
| 3,158,984 | 12/1964 | Butler | 139/425 |
| 4,481,079 | 11/1984 | Dawes | 162/348 |
| 4,633,596 | 1/1987 | Josef | 34/116 |
| 4,707,407 | 11/1987 | Clark et al. | 428/361 |
| 4,713,289 | 12/1987 | Shiffler | 428/361 |
| 4,943,476 | 7/1990 | Sokaris | 428/280 |
| 5,097,872 | 3/1992 | Laine et al. | 139/426 |
| 5,164,249 | 11/1992 | Tyler et al. | 428/225 |
| 5,169,709 | 12/1992 | Fleischer | 428/225 |
| 5,227,237 | 7/1993 | Saruyama et al. | 428/367 |

*Primary Examiner*—James J. Bell

*Attorney, Agent, or Firm*—Henry S. Jaudon; Cort Flint

[57] ABSTRACT

The invention is directed to a multi-layer papermaking fabric, preferably a forming fabric having superior stability characteristics along with uniform drainage characteristics. The fabric is formed with a single system of warp yarns evenly distributed over its width and interwoven with weft yarns arranged in a multi-layer stacked pattern. The weft yarns are arranged to consist of support surface layer weft yarns, running layer weft yarns and intermediate layer weft yarns.

15 Claims, 2 Drawing Sheets

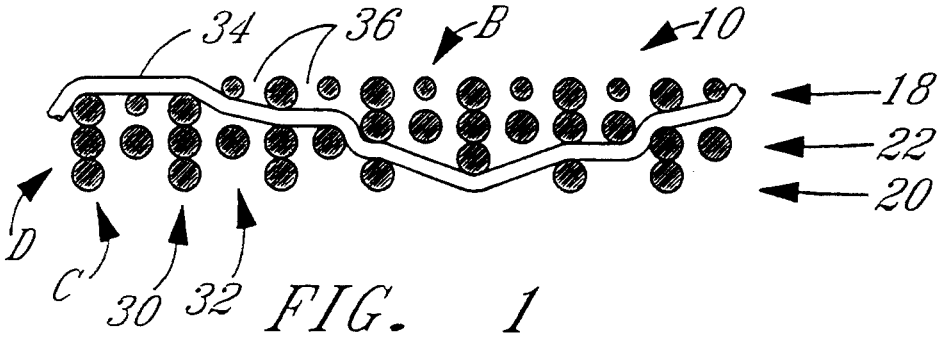
PRIOR ART
FIG. 1
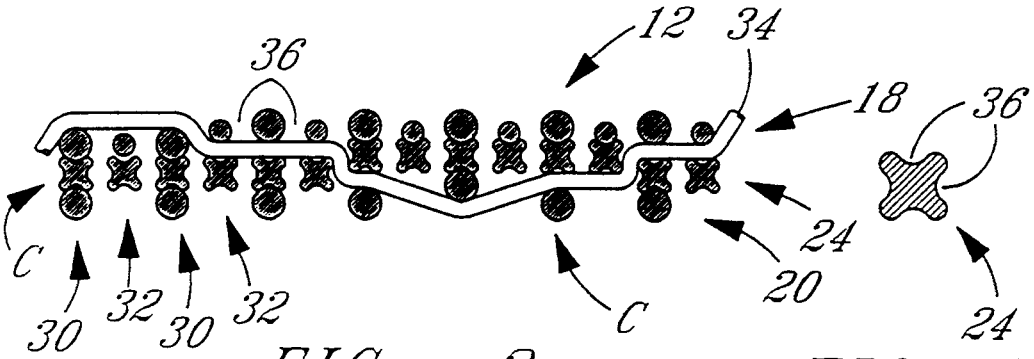
FIG. 2
FIG. 2A
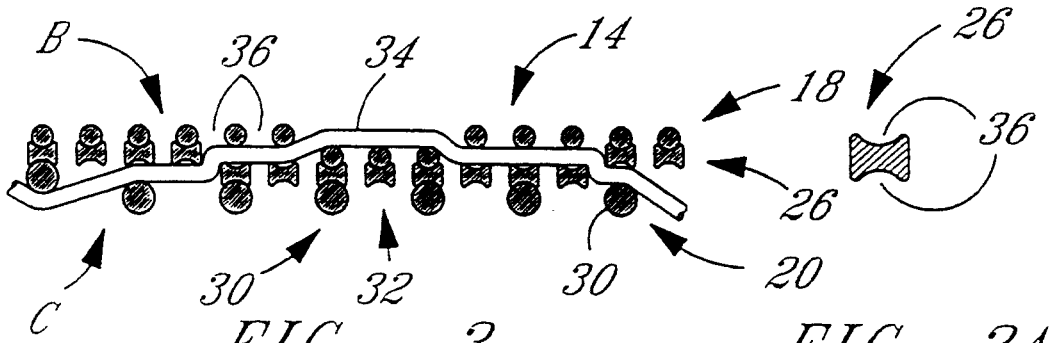
FIG. 3
FIG. 3A
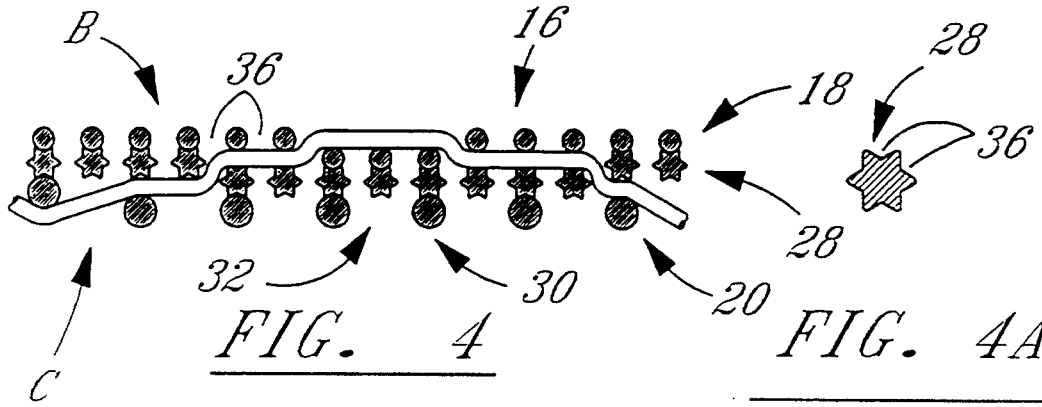
FIG. 4
FIG. 4A

MULTI-LAYERED PAPERMAKING FABRIC HAVING STABILIZED STACKED WEFT YARN

BACKGROUND OF THE INVENTION

The present invention is directed to a multi-layer papermaking fabric which is constructed to retain its rigidity, its uniform knuckle configuration and its uniform drainage characteristics while in use.

Multi-layer forming fabrics are well known and have long been used in the papermaking industry. Preferred structures of such forming fabrics are illustrated in U.S. Pat. Nos. 5,164,249; 4,640,741; and 5,169,709. These patents show various weave structures commonly used to form multi-layered papermaking fabrics. These fabrics possess the above referred desirably characteristics when formed. When put in service on a papermaking machine, the stacked weft yarns which extend transversely of the machine direction of the papermaking machine, have a tendency to become unstacked. This is particularly true when the weft is woven with long floats on the paper support surface and the running surface as in the referred to patents. When the stacked weft yarns become unstacked, the outer yarns slide to one side or the other of the supporting yarns. This movement alters the knuckle pattern presented on the support surface into a random arrangement. The knuckles then mark the paper product being formed on the forming fabric in a non-uniform manner. Further, when the weft yarns shift to the side of the supporting yarns, they fill or alter drainage channels. This results in uneven and sometimes insufficient drainage which results in the production of an inferior paper product.

Multi-layer forming fabrics, having stacked weft yarns, may be woven in higher densities with shorter floats. While this more compact structure presents a more stable fabric, it is very limited in amount of drainage which can be accommodated. Also, shorter weft floats reduce the life of the forming fabric due to greater exposure of the load bearing warp yarns.

Accordingly, it is an object of this invention to provide a multi-layer papermaking fabric in which weft yarns are retained in their woven position when the fabric is in use.

Another object of the invention is to provide a multi-layer papermaking fabric which allows uniform drainage in use.

Another object of the invention is to provide a multi-layered papermaking fabric in which the knuckle pattern on the support surface remains uniform in use.

Another object of the invention is to provide a multi-layer paper forming fabric having the above characteristics.

SUMMARY OF THE INVENTION

The invention is directed to a multi-layer papermaking fabric, preferably a forming fabric having superior stability characteristics along with uniform drainage characteristics. The fabric is formed with a single system of warp yarns evenly distributed over its width and interwoven with weft yarns arranged in a multi-layer stacked pattern. The weft yarns are arranged to consist of a support surface layer, a running layer and an intermediate layer.

The weft yarns of the support surface layer are normally formed of smaller diameter yarns than the other two support layers. The support weft yarns may be all of one diameter or they may be of multiple diameters.

The support surface weft yarns are formed to have circular cross-sections and are formed from synthetic monofilaments.

The running surface layer of weft yarns are normally formed of larger diameter yarns than the support surface weft yarns and are normally arranged to be beneath only certain of the support surface weft yarns. The running surface weft yarns are formed with circular cross-sections.

The weft yarns of the intermediate layer are formed of monofilaments having shaped cross-sections. The intermediate layer weft yarns are normally formed to have a greater thickness than the support surface layer weft yarns and to have a thickness either slightly larger, smaller or the same as that of the support surface weft yarns. The shaped cross-section of the intermediate layer weft yarns produce longitudinal channels along their outer surface. The preferred cross-sectional configurations are H-shaped, star-shaped and X-shaped.

The fabric weave provides for long runs or floats of the surface weft yarns between binding warp knuckles and similar long runs or floats of the running surface weft yarns between binding warp knuckles. This arrangement provides a weft dominated support surface for supporting the paper product and a weft dominated running surface for receiving the wear of the roller surfaces of the papermaking machine.

The long runs or floats of the support surface and running surface weft yarns allow these areas to come into direct contact with the intermediate layer weft yarns. The longitudinal grooves extending along the outer surface of the intermediate layer weft yarns receive the support surface and running surface weft yarns along these floats and provide stability against lateral shifting of these yarns. The fabric is thereby made to be more stable by the use of these shaped intermediate weft yarns.

It is preferred that the support and intermediate layer weft yarns are formed on polyester monofilaments to provide greater stability and stiffness. It is preferred that the running layer weft yarns be formed on polyamide monofilaments to provide greater wear resistance. Of course other synthetic materials could be used, such as polyesters, polyaryletherketones, as well as blends of those synthetics.

The thickness of the warp yarns of the support surface weft yarns preferably ranges between 0.12 mm and 0.19 mm. The thickness of the remaining layer weft yarns and the intermediate layer weft yarns preferably ranges between 0.18 mm and 0.26 mm.

The fabric is constructed to have a permeability factor of between 200 and 800 CFM.

DESCRIPTION OF THE DRAWINGS

FIG. 1 is a sectional side view of a multi-layer paper forming fabric having stacked weft yarn. The weft all have conventional circular cross-sections;

FIG. 2 is a sectional side view of a multi-layered paper forming fabric having stacked weft with the intermediate layer weft yarns being formed with an X-shaped cross-section;

FIG. 2A is an enlarged cross-section of the intermediate layer weft yarn of FIG. 2;

FIG. 3 is a sectional side view similar to FIG. 2 in which the cross-section of the intermediate layer weft yarn is H-shaped;

FIG. 3A is an enlarged view of the cross-section of the intermediate layer weft yarn of FIG. 3;

FIG. 4 is a sectional side view similar to FIGS. 2 and 3 in which the intermediate layer weft yarns have a star-shaped cross-sectional configuration;

FIG. 4A is an enlarged view of the star-shaped cross-section of the intermediate layer weft yarn of FIG. 4;

The construction designed to carry out the invention will hereinafter be described, together with other features thereof.

The invention will be more readily understood from a reading of the following specification and by reference to the accompanying drawings forming a part thereof, wherein an example of the invention is shown and wherein:

DESCRIPTION OF A PREFERRED EMBODIMENT

Figure 5:
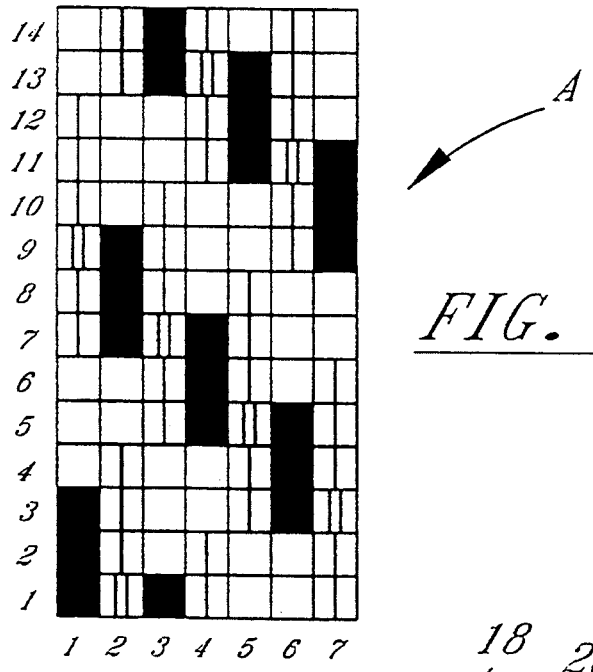
FIG. 5 is a diagram of the weave pattern.
Figure 6:
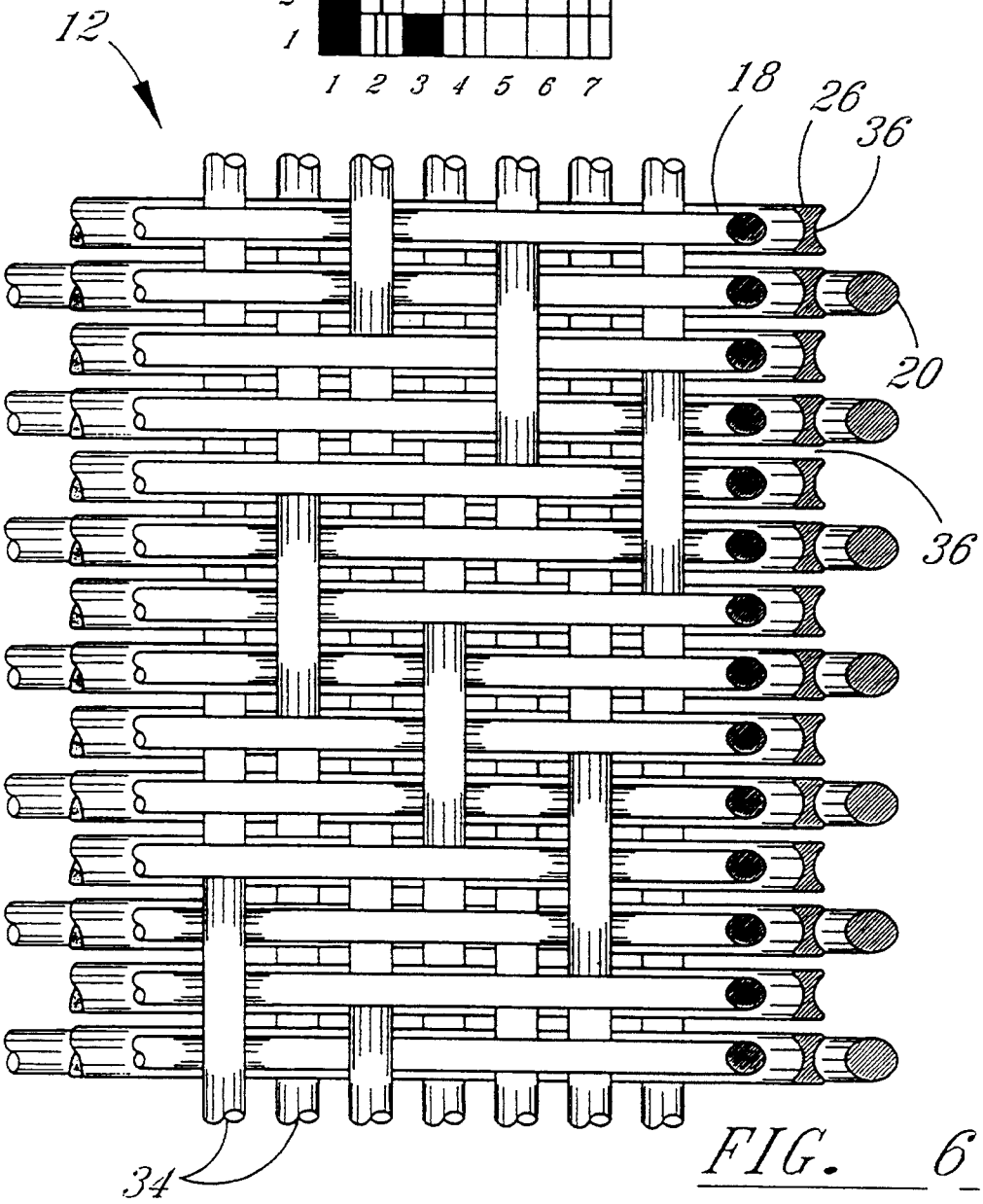
FIG. 6 is a cut-away, top view of the fabric shown in FIG. 3.

Referring now to FIG. 5 and 6, there is shown the weave diagram for a preferred weave pattern A for forming a multi-layered papermaking fabric constructed with stacked weft yarns and arranged in accordance with the invention. The weave pattern shown in FIG. 5 is a seven warp, fourteen pick repeating pattern. The diagram illustrates the support surface of the fabric and shows the weft yarn floating over runs of either four, or six warp yarns on each pick. This arrangement produces a weft dominant support surface.

As shown in FIGS. 1–4 and 6, forming fabrics 10, 12, 14, and 16 are formed with the weft yarn arranged in three layers comprising support surface B woven with support surface weft yarns 18, running surface C woven with running surface weft yarns 20 and intermediate layer weft yarns 22. These weft yarns 18, 20 and 22 are arranged in vertical stacks 30, 32 along the length of the fabric and are held in position by warp yarns 34 which weave over and under the weft yarns within each stack 30 or 32 along the length of the fabric as shown in FIGS. 1–4. Because the weft yarns are arranged in stacks 30, 32 clear drainage channels are formed between each of these stacks as indicated at 36. These drainage channels are formed into controlled sizes which determines the drainage capability of the paper forming fabric. Should any of the weft yarns 18, 20, 22 become unstacked and slip into a drainage channel, drainage through fabric 10 becomes uneven. Also, when shifting occurs, the texture of the support surface changes so that the markings on the paper product become random and un-uniform. Either of these occurrences produce a paper product of less that first quality.

The improvement according to the invention is shown in FIGS. 2–4.

In the first embodiment shown in FIGS. 2, 2A, paper forming fabric 12 is woven to have channels 36 formed by weft stacks 30, 32 which are arranged in an alternating manner along the fabric length. The vertical weft stacks 30, 32 are interwoven with warp yarn 34 as in the prior art arranged shown in FIG. 1. The support surface B is formed with support layer weft yarns 18 superimposed over intermediate layer weft yarns 24 and certain of the running surface C weft yarns 20.

Intermediate layer weft yarns are formed of shaped monofilaments which have been configured to have a cross-section in the form of an X. Channels 36, which extend longitudinally of monofilaments 24 are formed along the outer surface thereof.

As shown in FIGS. 2 and 6, the floats formed by the long runs of upper and lower weft yarns 18 and 20 allow these yarns to be drawn into grooves 36 by the warp yarns 34 to be held stably in stacked condition. Grooves 36 provide for a multi-layered paper forming fabric in which the weft yarns of stacks 30, 32 more positively retained in their relative positions.

FIGS. 3, 3A show a second embodiment similar to that shown in FIGS. 2, 2A wherein intermediate layer weft yarns 26 are configured with an H-shaped cross-section. Again, longitudinal channels 36 are formed along the length of yarns 26. These channels receive and retain support layer and running layer weft yarns 18 and 20.

FIG. 4, 4A depict a third embodiment similar to those shown in FIGS. 2 and 3. In FIG. 4, intermediate layer weft yarn 28 is formed with a star-shaped cross-section which produces at least six longitudinal grooves 36.

It is preferred that warp yarns 34 as well as support layer weft yarns 18 be formed of polyester monofilaments having a thickness of between 0.12 mm and 0.19 mm. As shown in FIGS. 2 and 3, these weft yarns may all be the same size, or may vary in size. They may be substantially equal the size of the intermediate layer weft yarns or smaller than these yarns.

Running layer weft yarns are preferably between 0.18 mm and 0.26 mm in diameter and are formed on polyamide monofilaments.

Intermediate layer weft yarns are also preferably formed of polyamide monofilaments and are sized to have a thickness of between 0.12 mm and 0.19 mm.

It is, of course, understood that any satisfactory synthetic material may be employed for the warp and weft yarns such as monofilaments formed of polyesters, polyaryletherketones and blends.

It is noted that each of the stacks could contain three weft yarn layers as at 30 or other arrangements between stacks 30, 32 could be utilized.

While a preferred embodiment of the invention has been described using specific terms, such description is for illustrative purposes only, and it is to be understood that changes and variations may be made without departing from the spirit or scope of the following claims.

What is claimed is:

1. A woven multi-layer papermaking fabric having uniform drainage characteristics and knuckle pattern comprising:

a system of warp yarns arranged side-by-side across the width of said fabric;

a system of vertically stacked weft yarns arranged in layers comprising support surface layer weft yarns intermediate layer weft yarns and running surface layer weft yarns;

said support surface layer weft yarns and said running surface layer weft yarns having circular cross-sections;

said intermediate layer weft yarns having shaped cross-sections which form a plurality of channels extending longitudinally along the length of said weft yarns; whereby said support surface layer weft yarns and said running surface layer weft yarns of said vertically stacked system of weft yarns engage in said channels of said intermediate layer weft yarns to be stably held in said stacked condition against lateral shifting.

2. The fabric of claim 1 wherein said system of vertically stacked weft yarns comprise certain weft stacks having support surface layer weft yarns, intermediate surface layer weft yarns and running surface layer weft yarns and certain other weft stacks comprise running layer surface weft yarns and intermediate surface weft yarns.

3. The fabric of claim 1 wherein the running surface layer weft yarns are of a single diameter.

4. The fabric of claim 1 wherein the support surface layer weft yarns are of a single diameter.

5. The fabric of claim 1 wherein the support surface layer weft yarns are of multiple diameters.

6. The fabric of claim 1 wherein the diameter of the support surface layer weft yarns is less than the diameter of the running surface layer weft yarns.

7. The fabric of claim 1 wherein the denier of all the intermediate layer weft yarns and the running surface layer weft yarns is the same.

8. The fabric of claim 1 wherein the denier of the running surface layer weft yarns is less than the denier of the intermediate layer weft yarn.

9. The fabric of claim 1 wherein the cross-section of the intermediate layer weft yarn is substantially X-shaped.

10. The fabric of claim 1 wherein the cross-section of the intermediate layer weft yarn is substantially H-shaped.

11. The fabric of claim 1 wherein the cross-section of the intermediate layer weft yarn is substantially star-shaped.

12. A woven multi-layer papermaking fabric for use with a papermaking machine having uniform drainage characteristics and knuckle pattern comprising:

a system of first yarns arranged side-by-side across the width of said fabric and extending in the machine direction;

a system of vertically stacked second yarns arranged in layers comprising support surface layer second yarns intermediate layer second yarns and running surface layer second yarns and extending the cross machine direction;

said support surface layer second yarns and said running surface layer second yarns having circular cross-sections;

said intermediate layer second yarns having shaped cross-sections which form a plurality of channels about the outer surface thereof, said channels extending longitudinally of said intermediate layer second yarns; whereby said support surface layer second yarns and said running surface layer second yarns of said vertically stacked system of second yarns engage in said channels of said intermediate surface layer second yarns to be firmly held in said stacked condition against lateral shifting.

13. The fabric of claim 12 wherein said system of vertically stacked second yarns comprise weft yarns.

14. The fabric of claim 12 wherein said system of first yarns interweave with said vertically stacked second yarns to assist in maintaining said second yarns in said stacked condition.

15. A woven multi-layer papermaking fabric for use with a papermaking machine having uniform drainage characteristics and knuckle pattern comprising:

a system of first yarns arranged side-by-side throughout a first direction of said fabric direction;

a system of vertically stacked second yarns arranged in layers comprising support surface layer second yarns intermediate layer second yarns and running surface layer second yarns, said system of vertically stacked second yarns extending throughout said fabric in a second direction;

said support surface layer second yarns and said running surface layer second yarns having circular cross-sections;

said intermediate layer second yarns having cross-sections configured to be one of substantially X shaped, substantially H shaped and substantially star shaped, said cross-section of said intermediate layer second yarns forming a plurality of channels extending longitudinally of said second yarns along their entire length; whereby said support surface layer second yarns and said running surface layer second yarns of said vertically stacked system of second yarns engage in said channels of said intermediate surface layer second yarns to be firmly held in said stacked condition against lateral shifting.

* * * * *